United States Patent [19]

Berkenhoff

[11] 4,032,208

[45] June 28, 1977

[54] CONNECTOR FOR TRACK LIGHTING SYSTEM

[75] Inventor: Hans Peter Berkenhoff, Ludenscheid, Germany

[73] Assignee: Lightcraft of California, Los Angeles, Calif.

[22] Filed: Mar. 22, 1976

[21] Appl. No.: 669,243

[52] U.S. Cl. ..... 339/88 R; 200/51.08; 339/21 R; 339/22 B

[51] Int. Cl.[2] ..... H01R 7/32; H01R 13/54

[58] Field of Search ..... 339/22 R, 22 B, 22 T, 339/88 R, 91 R, 21 R; 200/51.08

[56] References Cited

UNITED STATES PATENTS

| | | | |
|---|---|---|---|
| 3,215,969 | 11/1965 | Verrone | 339/91 R X |
| 3,603,918 | 9/1971 | Woertz | 339/22 T |
| 3,757,063 | 9/1973 | Hart et al. | 339/22 B X |

*Primary Examiner*—Roy Lake
*Assistant Examiner*—E. F. Desmond
*Attorney, Agent, or Firm*—Lindenberg, Freilich

[57] ABSTRACT

A connector for installation in a C-shaped track to support a lamp onto the track and make electrical connection between the lamp and conductors within the track, including a connector housing with a narrow head which fits through a slot in the track, so that when the connector is turned the head locks into the track and a pair of contact elements are then pressed against the conductors of the track. A knob on the base of the connector housing, is automatically depressed, to retract the contact elements, prior to the connector turning to its locked-in position. When the connector becomes fully turned, the knob springs up into the slot of the track and thereby causes the contact elements to move out and against the conductors of the track.

3 Claims, 10 Drawing Figures

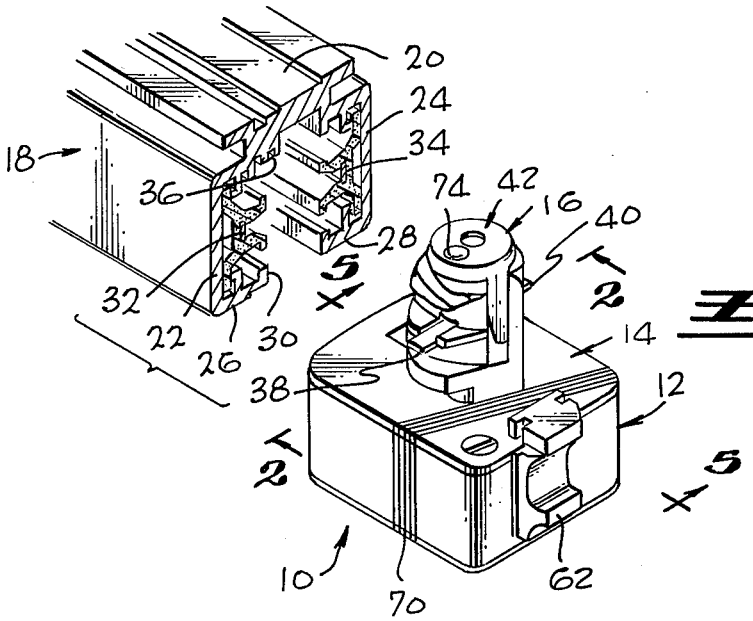
Fig. 1
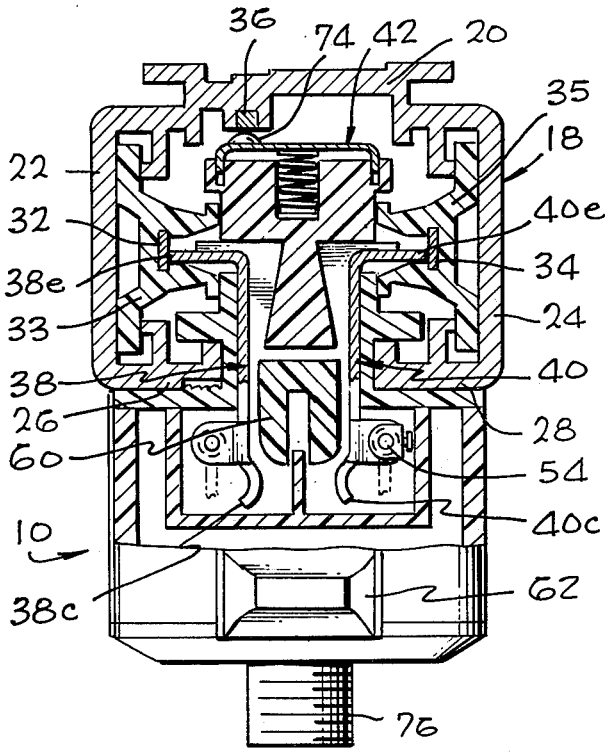
Fig. 2
Fig. 3
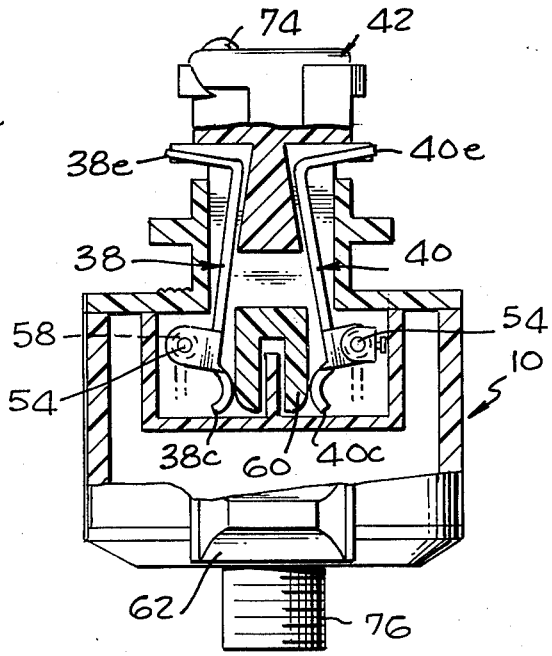

Fig. 9
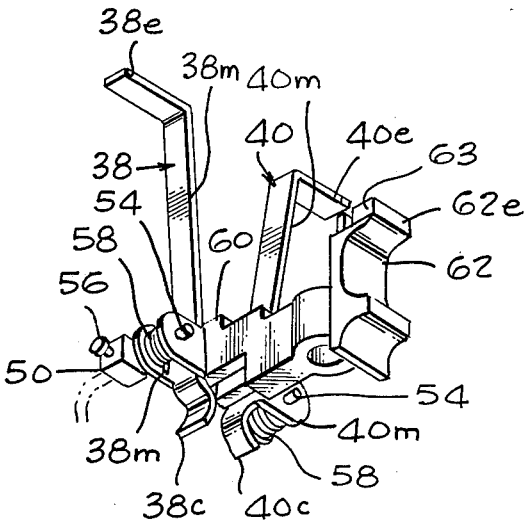
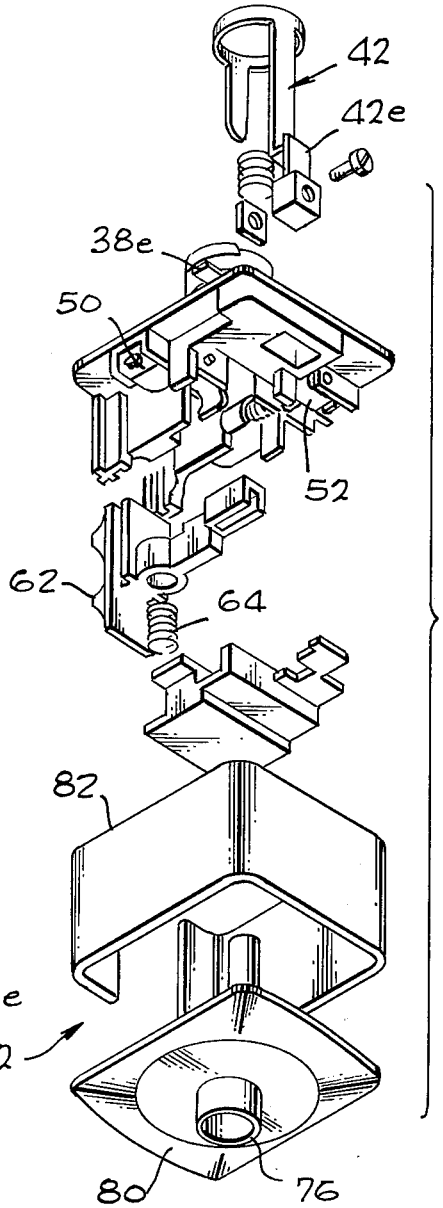
Fig. 10
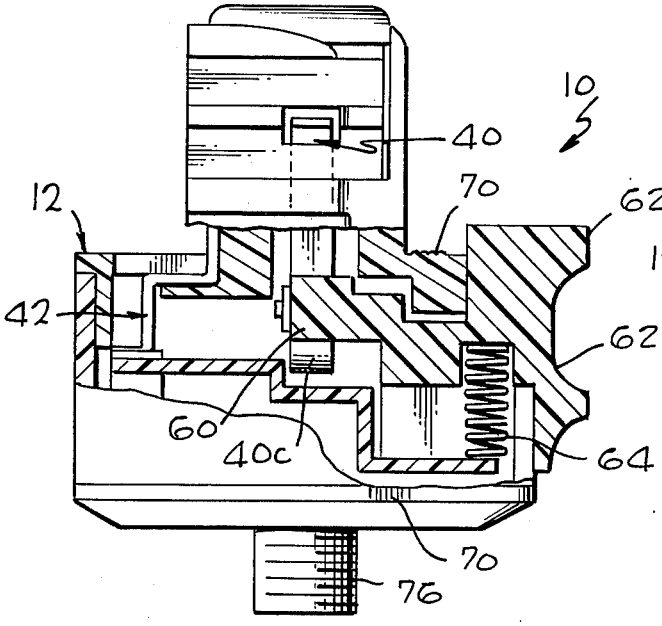
Fig. 5

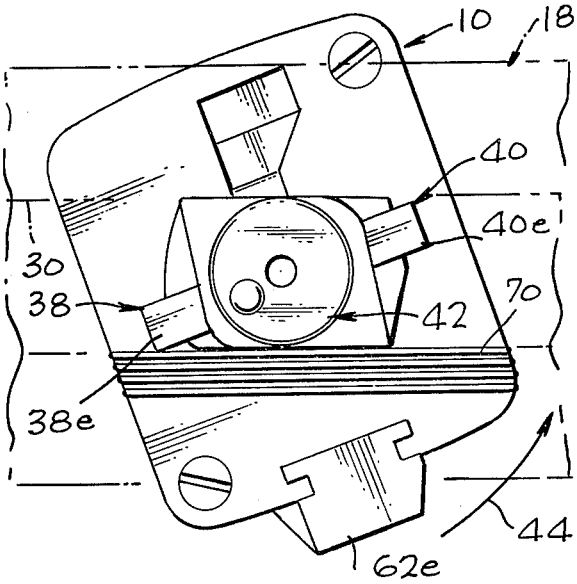
Fig. 6
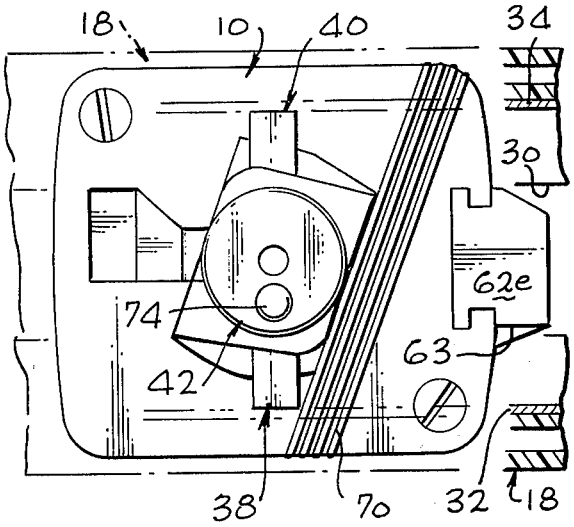
Fig. 7
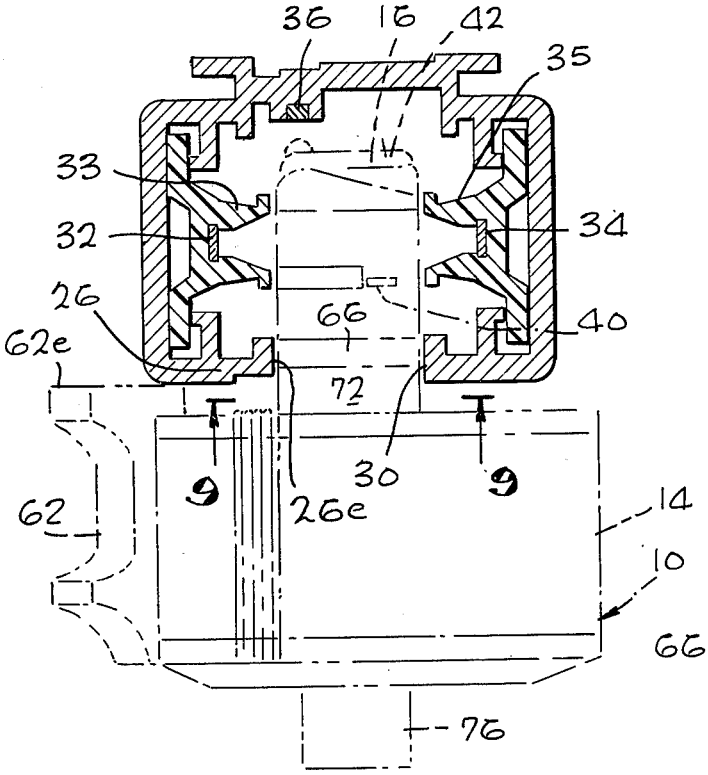
Fig. 8
Fig. 9
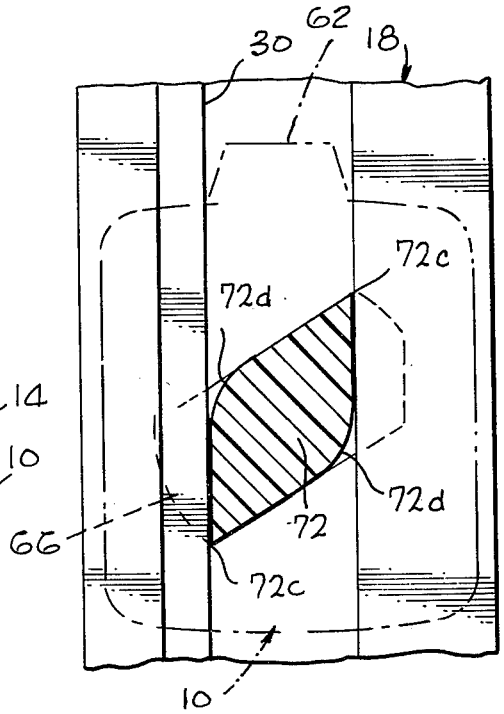

CONNECTOR FOR TRACK LIGHTING SYSTEM

BACKGROUND OF THE INVENTION

This invention relates to a connector designed for installation in a track to hold to the track and make electrical connection with conductors running along the track.

One type of lighting system includes a track containing electrical conductors and extending along a ceiling or wall, to support and make electrical connection to lamps. An adaptor or connector is utilized which can be easily installed through a slot in the track, to support the lamp and make electrical connection between wires in the lamp and the electrical conductors running along the track. A simple type of connector can be provided which is installed by merely inserting a narrow connector portion into the track and turning the connector to lock it into position, while spring biased contact elements press outwardly against the conductors in the track. However, point contact between the contact elements and track conductors may be established, if the connector is not fully turned. Such poor electrical connection at narrow points can lead to hot spots that can damage the track or connector, or cause fire. Also, when the contact elements scrape against the soft copper conductors while the connector is being turned, the elements can cause damage to the conductors, leading to hot spots when other connectors are later installed in that location.

SUMMARY OF THE INVENTION

In accordance with one embodiment of the present invention, a connector is provided, for installation in a track, which assures proper installation and which avoids damage to the conductors of the track. The connector includes a housing with a wide base for lying against the outside of the track, and with a narrow head for insertion into the track. A pair of contact element have end portions which can move out of the head and against the conductors of the track, or retract back into the head. A knob which moves on the base portion of the housing, is coupled to the contact elements to cause them to move into and out of the head. The knob is spring loaded to a position wherein it projects above the base and causes the contact element to project from the head. As the connector is being installed, the head cannot be fully inserted and turned unless the base is pressed hard enough against the track that the knob is depressed, to thereby cause retraction of the contact elements. However, as the connector approaches a fully locked-in position, the knob springs up into the slot in the track, to thereby cause the contact elements to project out of the head and against the conductors in the track.

The novel features of the invention are set forth with particularity in the appended claims. The invention will best be understood from the following description when read in conjunction with the accompanying drawings.

BRIEF DESCRIPTION OF THE DRAWINGS

FIG. 1 is a perspective view of a connector constructed in accordance with the present invention, showing its relationship to a track with which the connector is utilized;

FIG. 2 is a view taken on the line 2—2 of Figure 1, showing the connector in a fully installed configuration in the track;

FIG. 3 is a view similar to FIG. 2, but showing the connector in a configuration which it assumes during the early stage of installation in the track;

FIG. 4 is a partial perspective view showing some of the mechanism of the connector of FIG. 2;

FIG. 5 is a view taken on the line 5—5 of FIG. 1;

FIG. 6 is a plan view of the connector of FIG. 1, showing it in relation to the track at the beginning of installation therein;

FIG. 7 is a view similar to FIG. 6, but showing the connector in a configuration after complete installation in the track;

FIG. 8 is a sectional end view of the track, and showing the connector in phantom lines therein, during the beginning of the installation of the connector to the track;

FIG. 9 is a view taken on the line 9—9 of FIG. 8; and

FIG. 10 is an exploded perspective view of the connector of FIG. 1.

DESCRIPTION OF THE PREFERRED EMBODIMENTS

As illustrated in FIG. 1, the connector 10 includes a housing 12 with a wide base portion 14 and a narrower head portion 16. The connector is designed to be installed in a track 18 of C-cross section, which has a base wall 20, a pair of side walls 22, 24, and a pair of flanges 26, 28 that define a slot 30 between them. The track includes a pair of main electrical conductors 32, 34 that are connected to a power outlet (not shown), and a grounding conductor 36 which is connected to ground (as by connection to the ground terminal of a three wire outlet). The conductors 32, 34 lie at the bottom of grooves in a pair of insulators 33, 35 of the track. The connector is designed so that it can be readily installed anywhere along a long track, with a pair of contact elements 38, 40 on the connector engaged with the conductors 32, 34 on the track and with a grounding cap 42 on the connector engaged with the grounding conductor 36 of the track.

The connector 10 is installed by first inserting the head 16 of the connector through the slot 30 of the track, as illustrated in FIGS. 6 and 8, with the connector oriented so that the narrowest dimension of the head is aligned with the slot 30 in the track to enable such head insertion into the track. The connector is then turned as indicated by the arrow 44 in FIG. 6, approximately 70°, until the connector reaches the configuration illustrated in FIG. 7 with respect to the track 18. In the configuration of FIG. 7, the contact elements 38, 40 press against the conductors 32, 34 of the track to make electrical contact therewith.

The connector is constructed so that the ends of the contact elements 38, 40 are not extended from the connector housing, until nearly the completion of the installation, wherein the connector is at the configuration of Figure 7. Thus, during rotation of the connector, from the configuration of FIG. 6 to the configuration of FIG. 7, the contact elements 38, 40 are maintained in a retracted position so that they do not scrape along the copper conductors 32, 34 of the track during installation. Maintenance of the elements in a retracted position also assures that electrical contact is not established until complete turning of the connector when the contact elements are assured of making secure contact with the conductors of the track.

As illustrated in FIG. 4, the contact elements 38, 40 have middle portions 38m, 40m which are pivotally mounted on small fittings 50, 52 that are held to the housing of the connector. Each fitting has a pin 54 which projects through a pair of ears formed on the contact element, to pivotally support the element. Each pin also has a screw 56 for holding an end of an electrical wire to the fitting. Torsion springs 58 disposed about the pins, urge the contact elements to pivot apart so that their contacting ends 38*e*, 40*e* move apart to project further out of the connector. The contact elements also have cam follower ends 38*c*, 40*c* which can be moved apart by a cam 60, against the biasing of the springs 58 to retract the contacting ends 38*e*, 40*e* of the elements. The cam 60 is fixed to a knob 62 that can slide up and down, and that is urged upwardly by a knob-moving spring 64.

FIG. 2 illustrates the fully installed connector, wherein the knob 62 is in its raised position. Accordingly, the cam 60 lies in its raised position, which results in the contact elements 38, 40 being free to pivot so that their contacting ends 38*e*, 40*e* can move outwardly and against the electrical conductors 32, 34 of the track. FIG. 3 illustrates the connector in a configuration wherein the knob 62 has been depressed against the force of the knob-biasing spring. This results in the cam 60 moving down to deflect the cam followers 38*c*, 40*c* of the contact elements so that the elements pivot and their contacting ends 38*e*, 40*e* are retracted.

The connector is constructed to assure that the contacting ends 38*e*, 40*e* of the elements are retracted during rotation of the connector in the track, from the position of FIG. 6 to that of FIG. 7. To assure this, the knob 62 is constructed, as best shown in FIG. 8, so that when the knob is upwardly biased its upper end 62*e* lies above the top of the base 14 of the connector. Thus, when the head 16 of the connector is first inserted through the slot 30 of the track, insertion to full depth is resisted by the upstanding knob portion 62*e* which abuts the flange 26 of the track. At the position shown in FIG. 8, the connector cannot be turned because a barrier 66 on the connector housing is prevented from turning. A person installs the connector by pressing it up from the position shown in FIG. 8, so that the base 14 of the connector rises up against the track, causing the barrier 66 to rise above the walls of the slot 30. Such raising of the base 14 results in the knob 62 being depressed relative to the base, therefore causing the contact elements 38, 40 to be retracted. As the connector is then turned towards the configuration of FIG. 7, the knob 62 remains depressed and the contacting ends of the elements remain retracted. When the connector has been completely turned, to the position of FIG. 7, the upper knob portion 62*e* becomes aligned with the slot 30, and can rise up again into the slot under the biasing of its spring. The trailing edge 63 of the knob forms a fairly sharp corner so that the knob is suddenly relased to create a "click" sound when it springs up. As shown in FIG. 2, the now-risen knob 62 allows the contact elements 38, 40 to spring apart, so that their contacting ends 38*e*, 40*e* move in directions primarily perpendicular to the surfaces of the conductor 32, 34 of the track and into the contact with them.

When a person installs the connector, he hears a click when the knob 62 springs up into the slot 30 of the track. Thus, the person knows when the connector has been fully installed. After such installation, the connector cannot become loosened by vibration or the like, because the knob 62 prevents turning of the connector unless the knob is pressed down. Of course, such depressing of the knob causes retraction of the contact elements so that they do not engage the conductors 32, 34 of the track during turning to disengage the connector.

The connector 10 is designed to be initially inserted into the track while in the configuration shown in FIG. 6, wherein at least part of the upper knob portion 62*e* lies under a portion of the track. In order to aid the installer, the housing of the connector is formed with visible lines 70 which must be substantially aligned with one edge 26*e* of the slot, in order to insert the head of the connector into the slot and to turn it. Once inserted, the connector can be turned only in the position shown by arrow 44 in FIG. 6. This is because a cut-away portion 72 (FIGS. 8 and 9) at the base of the head is formed as a parallelogram with two corners 72*c* forming an angle of less than 90° and pointed, and with the other two corners 72*d* forming angles of more than 90° and being rounded. The cut-away portion 72 permits turning of the connector only between the positions of FIG. 6 and 7, and prevents any turning beyond these positions.

The grounding cap 42 at the top of the connector is spring biased upwardly. When the head of the connector is pressed into the track and the connector is turned to its fully installed position, a bump 74 (FIG. 1) on the cap engages the grounding conductor 36 in the track to make good contact therewith.

The connector 10 is designed to hold a lighting fixture and carry electrical current thereto. A threaded stud 76 at the bottom of the connector housing can hold a lighting fixture, while electrical wires pass through a hole in the stud and are connected to the fittings 50, 52 that are coupled to the contact elements, and with a wire connected to the grounding cap 42. A workman can remove a bottom wall 80 (FIG. 10) and a cover 82 from around the base of the connector housing to expose the fittings 50, 52 and an extension 42*e* on the grounding cap, to make electrical connections therewith. The workman then reassembles the connector, lifts the fixture and connector thereon and installs the connector as described above, at any location along the track. The track and connector are especially useful for displaying lighting fixtures in stores that sell them, and in enabling fixtures to be removed and sold and new fixtures to be installed.

Thus, the invention provides an easily installed and secure connector for use with a track, wherein the contact elements of the connector move substantially perpendicularly against the conductors of the track instead of scraping along them, during installation. This is accomplished by the use of contact elements that are movable to retract and project, and by utilizing a knob that is automatically depressed during the initial portion of the installation, so that the contact elements remain retracted until the end of installation. At the end of installation, when the connector has been fully turned, the contact elements are projected against the conductors of the track, and an audible click can be heard by the person installing the connector to inform him that installation has been completed.

Although particular embodiments of the invention have been described and illustrated herein, it is recognized that modifications and variations may readily occur to those skilled in the art and consequently it is intended that the claims be interpreted to cover such modifications and equivalents.

I claim:

1. In combination with a tube-like track having a slot therein, and having a pair of electrical conductors at either side of the track, a track connector comprising:

a connector housing with a base and with a narrow head which can pass through said track slot at a first orientation of said housing but not at a second orientation angled from said first orientation, said head having a cut-away location to allow said head to turn in said slot when pressed to a predetermined depth in said track;

a pair of contact elements movably mounted on said connector housing, and having end portions movable against and away from said track conductors;

a knob movably mounted on said base and biased to a projecting position wherein said knob projects from said base so that when said housing is at said first orientation and is pressed to said predetermined depth in said track, said knob is depressed against the force of said biasing to a depressed knob position;

said knob being narrow enough and being positioned so that when said housing is turned to said second orientation said knob is aligned with said track slot and moves into said track slot under the force of said biasing, said knob then preventing turning back of said housing until the knob is manually depressed; and means coupling said knob to said contact elements, for moving said end portions of said elements toward and away from said conductors in response to movement of said knob respectively between said projecting and depressed knob positions, whereby the contact elements do not move against the track conductors until the connector nearly reaches its fully installed configuration.

2. A connector for installation in a tube-like track of predetermined size which has a slot and which has a pair of electrical conductors comprising:

a connector housing which includes a wide base for lying against a track and a narrower head for lying within the track, said head being constructed so it can be inserted through the track slot at a first orientation of said connector but not at a second orientation angled from said first orientation;

a pair of contact elements movably mounted on said housing and having end portions which project from said head of said housing to move against and away from said track electrical conductors;

a knob movably mounted on said base to move between first and second positions, said knob being biased towards said second position, and having a projecting knob portion positioned so that when said connector is in said first orientation and is pressed against said track, said projecting knob portion is moved to said first position, and said knob being constructed so that said projecting knob portion is free to move to said second position when said connector is oriented at said second orientation; and cam means coupled to said knob and to said contact elements to move said elements so their end portions retract and project as said knob between said first and second positions.

3. In a connector for installation in a tube-like track which has a slot and which has a pair of electrical conductors, wherein the connector had a head portion which can enter the track slot at a first orientation of the head portion the head portion having a pair of contact elements for engaging said conductors when the head portion turns to a second orientation, the improvement comprising:

a member moveably mounted on said connector and coupled to said contact elements to retract and extend the elements with respect to the tract conductors as said member moves between first and second positions, said member being positioned so it contacts said track and is maintained by said track at said first position when said head portion lies in said track at its first orientation, but said member is free to move to said second position as said head portion turns to its second orientation; and spring means for urging said member to said second position.

* * * * *